US007274282B2

(12) United States Patent
Park et al.

(10) Patent No.: US 7,274,282 B2
(45) Date of Patent: Sep. 25, 2007

(54) TRANSFORMER

(75) Inventors: Jung Heyn Park, Jeonbuk (KR); Jong Rak Kim, Suwon (KR); Kyoung Ho Yoon, Whasung (KR); Suh Woo Choi, Seoul (KR); Young Gun Hong, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 11/320,776

(22) Filed: Dec. 30, 2005

(65) Prior Publication Data

US 2006/0290453 A1 Dec. 28, 2006

(30) Foreign Application Priority Data

Jun. 23, 2005 (KR) ..... 10-2005-0054498

(51) Int. Cl.
*H01F 27/29* (2006.01)

(52) U.S. Cl. ..... 336/192
(58) Field of Classification Search ..... 336/65, 336/83, 170, 180–183, 192, 198
See application file for complete search history.

(56) References Cited

U.S. PATENT DOCUMENTS 7,015,784 B2 * 3/2006 Kohno ..... 336/170

FOREIGN PATENT DOCUMENTS

| | | |
|---|---|---|
| JP | 7-22528 | 1/1995 |
| JP | 8-64432 | 3/1996 |
| KR | 20-292121 | 10/2002 |

* cited by examiner

*Primary Examiner*—Tuyen T. Nguyen
(74) *Attorney, Agent, or Firm*—Stanzione & Kim, LLP

(57) ABSTRACT

The present invention relates to a transformer. In the transformer, secondary winding sections are placed in both sides of a primary winding section, all terminals of the secondary winding sections are used as output terminals, and an input terminal is placed in the opposite side to the output terminals. Therefore, a return wire in the high-voltage output side does not need to be provided, and a sufficient insulation separation distance is secured in the relation with a printed circuit board, which makes it easy to implement a circuit. Further, improved efficiency is obtained over a conventional transformer, there is a significant reduction in cost, and products using the transformer can be small in size. The transformer includes a bobbin composed of one primary winding section having one input terminal and one ground terminal and 2n (n: positive number) secondary winding sections, each secondary winding section having two output terminals; a primary coil wound around the primary winding section; secondary coils wound around the 2n secondary winding sections; and a pair of cores that are respectively inserted into an insertion hole formed inside the bobbin.

11 Claims, 9 Drawing Sheets

TRANSFORMER

CROSS-REFERENCE TO RELATED APPLICATIONS

This application claims the benefit of Korean Patent Application No. 2005-54498 filed with the Korea Industrial Property Office on Jun. 23, 2005, the disclosure of which is incorporated herein by reference.

BACKGROUND OF THE INVENTION

1. Field of the Invention

The present invention relates to a transformer. In the transformer, secondary winding sections are placed in both sides of a primary winding section, all terminals of the secondary winding sections are used as output terminals, and an input terminal is placed in the opposite side to the output terminals. Therefore, a return wire in a high-voltage output side does not need to be provided, and a sufficient insulation separation distance is secured in the relation with a printed circuit board, which makes it easy to implement a circuit. Further, improved efficiency is obtained over a conventional transformer, there is a significant reduction in cost, and products using the transformer can be small in size.

2. Description of the Related Art

Recently, as techniques related to display devices develop, liquid crystal display (LCD) monitors are tending to be widely used in a computer or other display devices. Compared with a CRT monitor, the LCD monitor has an advantage in that the vertical cross-section thereof becomes slim and flickering hardly occurs. The LCD monitor has a fluorescent lamp, which is driven by a high voltage, for a back light system which needs a back-light module.

An inverter including a driving circuit is used to drive the fluorescent lamp. The inverter has a high-voltage transformer, which generates a high AC output voltage from a low AC input voltage so as to supply the voltage to a lamp composing an LCD panel.

The conventional transformer drives one transformer to supply electric power to one lamp. However, in the case where external electrode fluorescent lamps (EEFL) or cold cathode fluorescent lamps (CCFL) are driven in parallel, several transformers are driven to supply electric power to several lamps.

As the LCD TV market or monitor market reaches maturity, the selling price of LCD or monitor decreases, and thus the prices of parts related to a backlight unit decreases accordingly.

Therefore, manufacturers have tried to reduce the number of parts and the unit cost per parts because of this price pressure related to the parts of a backlight unit. As a part of such an effort, attempts to develop a product, in which several lamps can be driven by one transformer, are being made actively.

FIGS. 1A and 2A are plan views of a transformer according to the related art which can drive one lamp, and FIGS. 1B and 2B are diagrams illustrating an equivalent circuit of the transformer.

The transformer shown in FIG. 1A includes a bobbin 100 composed of one primary winding section 101 and one secondary winding section 102, on which a plurality of insulating slits 106 are formed, primary coil and secondary coils 107 and 108 which are respectively wound around the primary and second winding sections 101 and 102, and a pair of cores (not shown) which are inserted into an insertion hole formed inside the bobbin 100.

As shown in FIG. 1A, a primary-side voltage is applied through an input terminal (not shown) formed in the primary winding section 101, and the secondary winding section 102 is provided with two terminals 103 and 104, one terminal 103 being used as an output terminal and the other terminal 104 being used as a ground terminal. Therefore, as shown in the equivalent circuit of FIG. 1B, the transformer can drive only one lamp.

The winding of the secondary coil 108 starts from the output terminal 103 of the secondary winding section 102 and is completed at the ground terminal 104 thereof, thereby causing a return wire 105 to pass through the high-voltage output side. Accordingly, the high-voltage output side and the return wire 105 should be insulated.

In addition, the pair of cores are inserted into the insertion hole formed inside the bobbin 100. In the transformer, an E-shaped core or UI-shaped core can be used, the UI-shaped core being formed by a combination of a U-shaped core forming an outer magnetic path and an I-shaped core forming an inner magnetic path.

As in the transformer shown in FIG. 1A, a transformer shown in FIG. 2A includes a bobbin 100 composed of one primary winding section 201 and one secondary winding section 202, on which a plurality of insulating slits 206 are formed, primary coil and secondary coils 207 and 208 which are respectively wound around the primary and second winding sections 201 and 202, and a pair of cores (not shown) which are inserted into an insertion hole formed inside the bobbin 200.

In addition, a primary-side voltage is applied through an input terminal (not shown) formed in the primary winding section 201, and the secondary winding section 202 is provided with two terminals 204 and 205, one terminal 204 of the terminals being used as an output terminal. Therefore, as shown in FIG. 2B, the transformer can also drive only one lamp.

In the transformer shown in FIG. 2A, the secondary coil 208 is wound in a different manner from the transformer shown in FIG. 1A. That is, the winding of the secondary coil 208 starts from a terminal 203 of the primary winding section 201 and is completed at the output terminal 204 of the secondary winding section 202. Therefore, the transformer has an advantage in that a return wire passing though the high-voltage output side does not need to be provided, which means the insulation between the return wire and the high-voltage output side does not need to be considered.

Furthermore, as in the transformer of FIG. 1A, the pair of cores are inserted into the insertion hole formed in the bobbin 200. In the transformer, an E-shaped core or UI-shaped core can be used, the UI-shaped core being formed by a combination of a U-shaped core forming an outer magnetic path and an I-shaped core forming an inner magnetic path.

FIGS. 3A and 4A are plan views of a transformer according to the related art, which drives two lamps. FIGS. 3B and 3C are diagrams illustrating an equivalent circuit of the transformer, and FIGS. 4B and 4C are diagrams illustrating an equivalent circuit of the transformer.

The transformer shown in FIG. 3A includes a bobbin 300 composed of one primary winding section 301 and one secondary winding section 302, on which a plurality of insulating slits 306 are formed, primary coil and secondary coils 307 and 308 which are respectively wound around the primary and second winding sections 301 and 302, and a pair of cores (not shown) which are inserted into an insertion hole formed inside the bobbin 300.

As shown in FIG. 3A, a primary-side voltage is applied through an input terminal (not shown) formed in the primary winding section 301, and the secondary winding section 302 is provided with two terminals 303 and 304, the terminals 303 and 304 being used as output terminals. Therefore, as shown in the equivalent circuit of FIG. 3A or 3C, the transformer can drive two lamps or one U-shaped lamp to thereby have more improved efficiency than the transformers shown in FIGS. 1A and 2A.

However, the winding of the secondary coil 308 starts from one output terminal 303 of the secondary winding section 302 and is completed at the other output terminal 304 thereof, thereby causing a return wire 305 to pass though the high-voltage output side, as in the transformer shown in FIG. 1A. Accordingly, the high-voltage output side and the return wire 305 should be insulated.

As in the transformers of FIGS. 1A and 2A, the pair of cores are inserted into the insertion hole formed inside the bobbin 300. In the transformer, an E-shaped core or UI-shaped core can be used, the UI-shaped core being formed by a combination of a U-shaped core forming an outer magnetic path and an I-shaped core forming an inner magnetic path.

The transformer shown in FIG. 4A includes a bobbin 400 composed of one primary winding section 401 and two secondary winding sections 402, in which a plurality of insulating slits 405 are formed, primary and secondary coils 406 and 407 which are respectively wound around the first and secondary winding sections 401 and 402, and a pair of cores 408 which are inserted into an insertion hole formed inside the bobbin 400.

As shown in FIG. 4*a*, the primary winding section 401 is provided with two input terminals 403*a* and 403*b*, through which a primary-side voltage is applied. The second winding section 402 is provided with four terminals 404*a* to 404*d*, two terminals 404*a* and 404*d* being used as output terminals and two terminals 404*b* and 404*c* being used as ground terminals. Therefore, as shown in FIGS. 4*b* and 4*c*, the transformer can drive two lamps or one U-shaped lamp at the same time to thereby have more improved efficiency than the transformers shown in FIGS. 1A and 2A.

The primary winding section 401 is placed in the center of the bobbin 400, and the secondary winding sections 402 are respectively placed in both sides of the primary winding section 401. In other words, two secondary winding sections 402 are placed in one bobbin, so that one transformer can drive two lamps or one U-shaped lamp.

The winding of the secondary coil 407 starts from the input terminals 403*a* and 403*b* of the primary winding section 401 and is completed at the output terminals 404*a* and 404*d* of the secondary winding section 402. Therefore, in the above transformer, a return wire passing through the high-voltage output side does not need to be provided, which means the insulation between the high-voltage output side and the return wire does not need to be considered. In general, the transformer is being widely used among transformers according to the related art.

As in the transformers described above, the pair of cores 408 are inserted into the insertion hole formed inside the bobbin 400. In the transformer, an E-shaped core or UI-shaped core can be used, the UI-shaped core being formed by a combination of a U-shaped core forming an outer magnetic path and an I-shaped core forming an inner magnetic path.

However, in the conventional transformers as described above, all the terminals of the secondary winding section are not used as an output terminal, so several lamps cannot be driven at the same time. Therefore, utilization efficiency is considerably decreased, significant costs are wasted, and products using a transformer become large in size.

In addition, the primary and secondary winding sections are placed in a line in one bobbin. The winding of secondary coil starts from one output terminal of the secondary winding section and is completed at the other output terminal thereof. As a result, the high-voltage output side and the return wire should be insulated because of the return wire passing through the high-voltage output side, and a waveform of output current is distorted.

Furthermore, in the case of the transformer in which the input terminal is not placed in the opposite side of the output terminal, a sufficient insulation separation distance cannot be secured in the relation with a printed circuit board which is electrically connected thereto, which makes it hard to implement a circuit.

SUMMARY OF THE INVENTION

An advantage of the present invention is that it provides a transformer, in which secondary winding sections are placed in both sides of a primary winding section, all terminals of the secondary winding sections are used as output terminals, and an input terminal is placed in the opposite side to the output terminals. Therefore, a return wire in the high-voltage output side does not need to be provided, and a sufficient insulation separation distance is secured in the relation with a printed circuit board, which makes it easy to implement a circuit. Further, improved efficiency is obtained over a conventional transformer, there is a significant reduction in cost, and products using the transformer can be small in size.

Additional aspects and advantages of the present general inventive concept will be set forth in part in the description which follows and, in part, will be obvious from the description, or may be learned by practice of the general inventive concept.

According to an aspect of the invention, a transformer includes a bobbin composed of one primary winding section having one input terminal and one ground terminal and 2n (n: positive number) secondary winding sections, each secondary winding section having two output terminals; a primary coil wound around the primary winding section; secondary coils wound around the 2n secondary winding sections; and a pair of cores that are respectively inserted into an insertion hole formed inside the bobbin.

According to another aspect of the invention, the primary winding section is placed in the center of the bobbin, and the n secondary winding sections are respectively placed in both sides of the primary winding section.

According to a further aspect of the invention, on the primary and secondary winding sections, a plurality of insulating slits are formed.

According to a still further aspect of the invention, when the primary coil is wound, the winding starts from the input terminal of the primary winding section and is completed at the ground terminal thereof.

According to a still further aspect of the invention, when the secondary coil is wound, the winding starts from one output terminal of the secondary winding section and is completed at the other output terminal thereof.

According to a still further aspect of the invention, the input terminal and ground terminal of the primary winding section are placed in the same direction.

According to a still further aspect of the invention, the output terminals of the secondary winding section are placed in the same direction.

According to a still further aspect of the invention, the input terminal of the primary winding section is placed in the opposite side to the output terminals of the secondary winding sections.

According to a still further aspect of the invention, two output terminals placed in the outermost sides from the center of the bobbin are placed on both side surfaces of the bobbin.

According to a still further aspect of the invention, the core is an E-shaped core.

According to a still further aspect of the invention, the core is formed by a combination of a U-shaped core forming an outer magnetic path and an I-shaped core forming an inner magnetic path.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
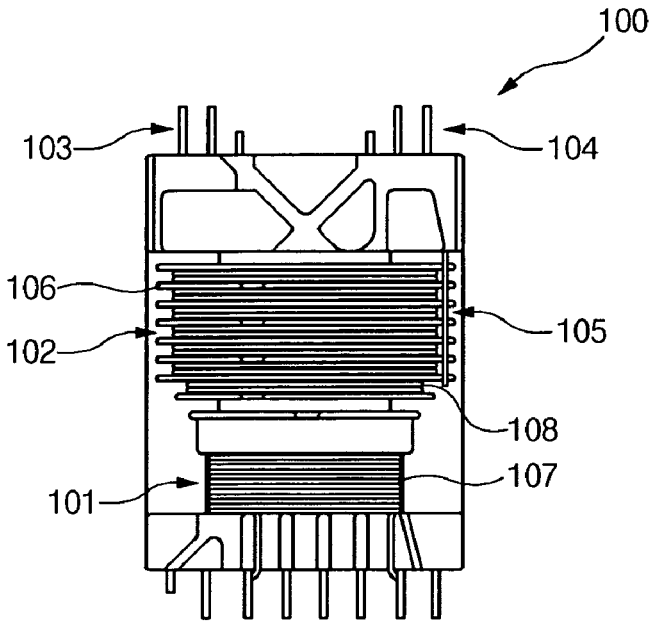
FIG. 1A (PRIOR ART)
FIGS. 1A and 2A are plan views of a transformer according to the related art which drives one lamp.
Figure 1B:
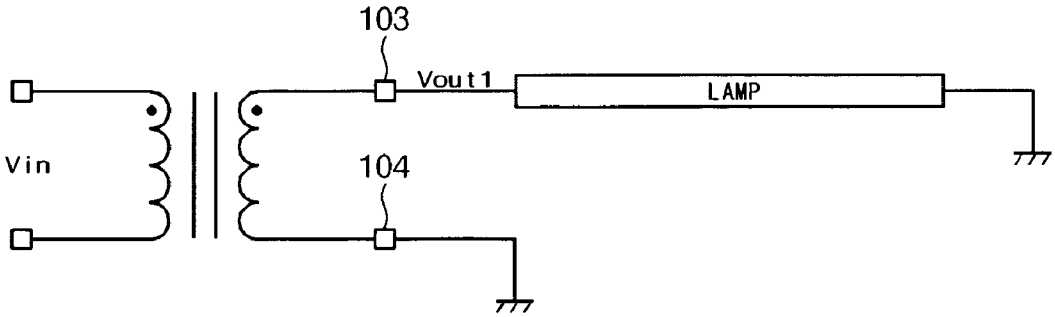
FIG. 1B (PRIOR ART)
FIGS. 1B and 2B are diagrams illustrating an equivalent circuit of the transformer according to the related art which drives one lamp.
Figure 2A:
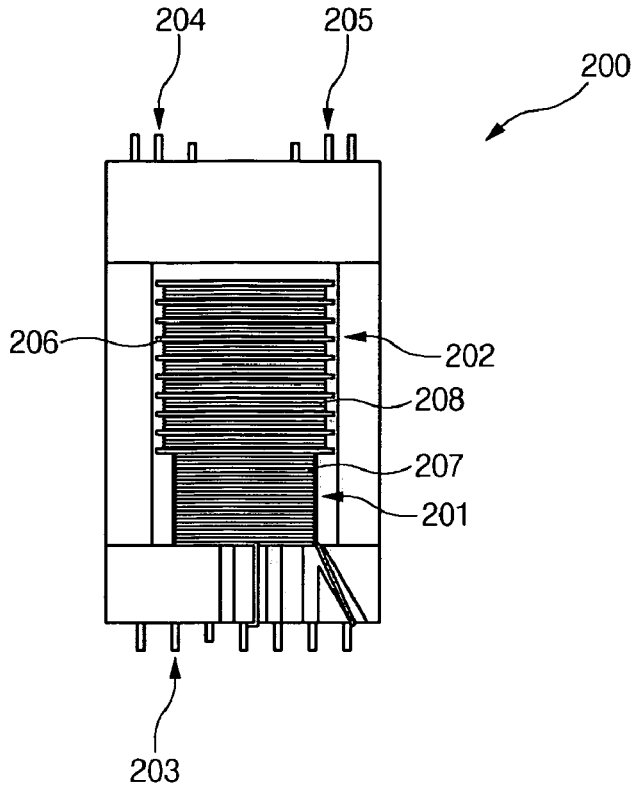
FIG. 2A (PRIOR ART)
Figure 2B:
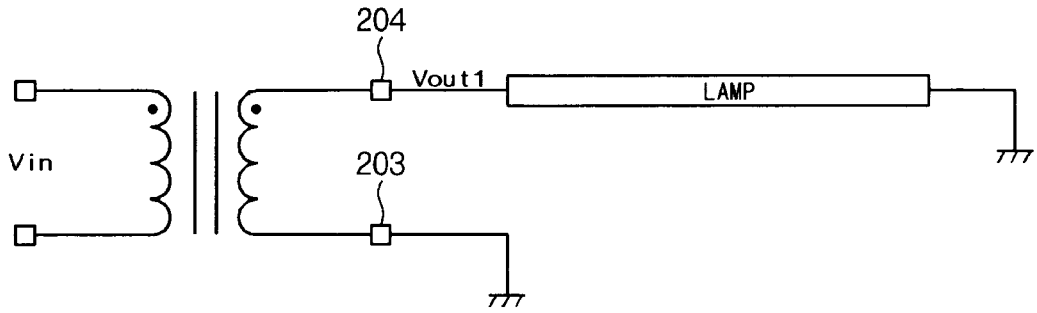
FIG. 2B (PRIOR ART)
Figure 3A:
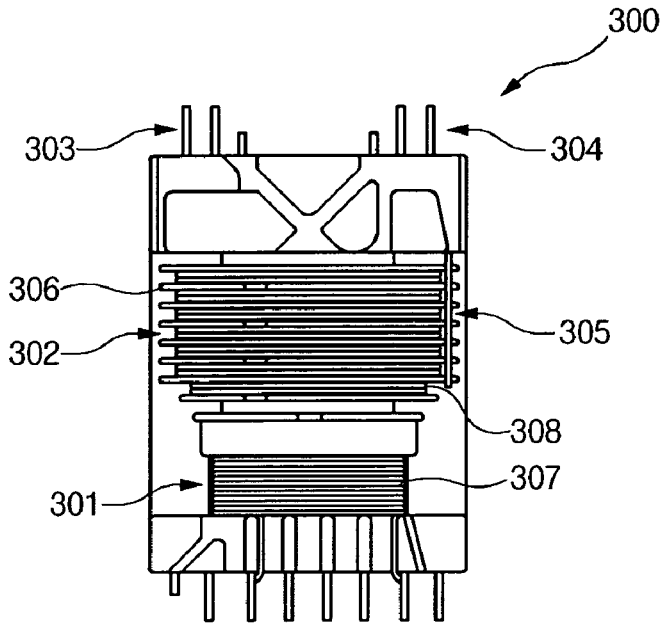
FIG. 3A (PRIOR ART)
FIGS. 3A and 4A are plan views of a transformer according to the related art which drives two lamps.
Figure 3B:
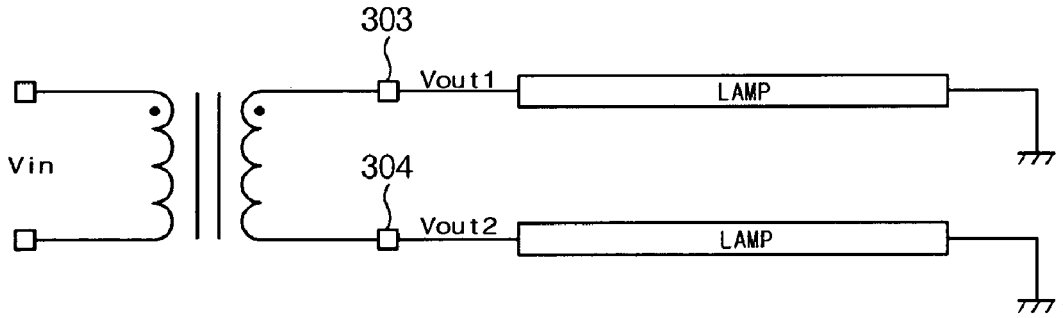
FIG. 3B (PRIOR ART)
FIGS. 3B and 3C are diagrams illustrating an equivalent circuit of the transformer according to the related art which drives two lamps.
Figure 3C:
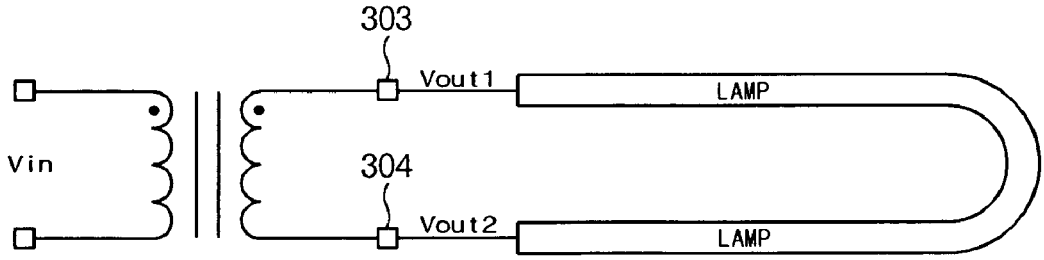
FIG. 3C (PRIOR ART)
Figure 4A:
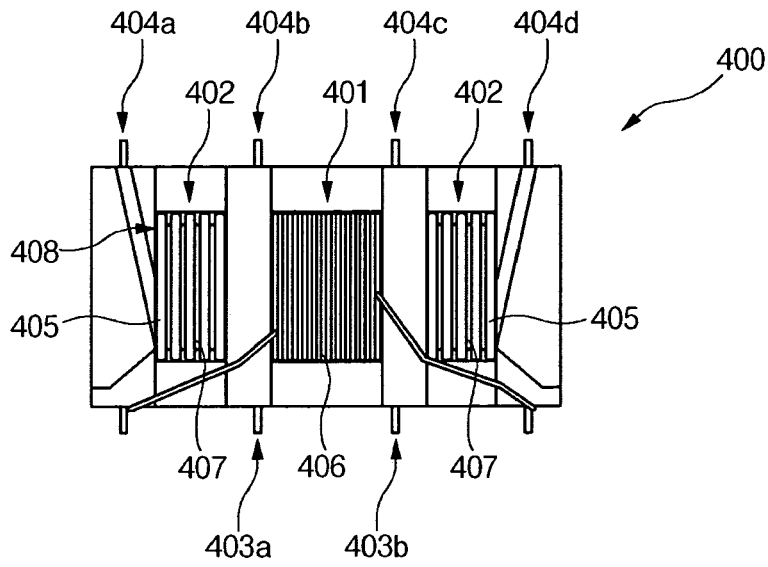
FIG. 4A (PRIOR ART)
Figure 4B:
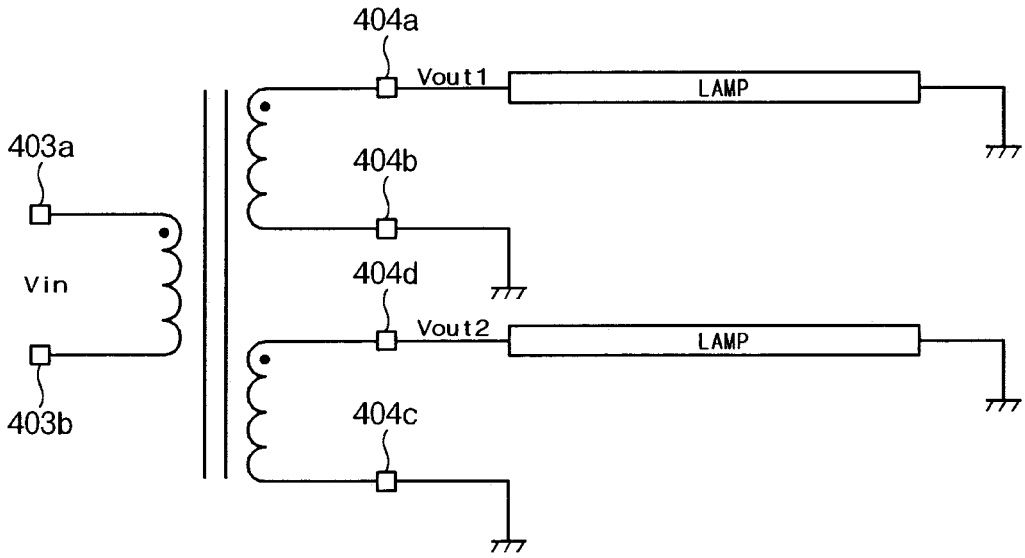
FIG. 4B (PRIOR ART)
FIGS. 4B and 4C are diagrams illustrating an equivalent circuit of the transformer according to the related art which drives two lamps.
Figure 4C:
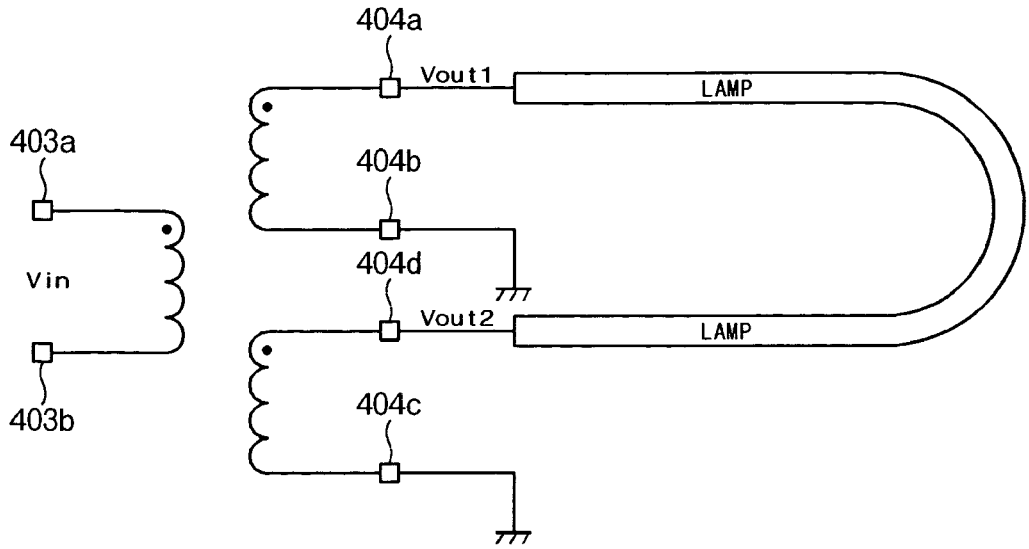
FIG. 4C (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, preferred embodiments of the present invention will be described in detail with reference to the accompanying drawings.

First Embodiment

Figure 5A:
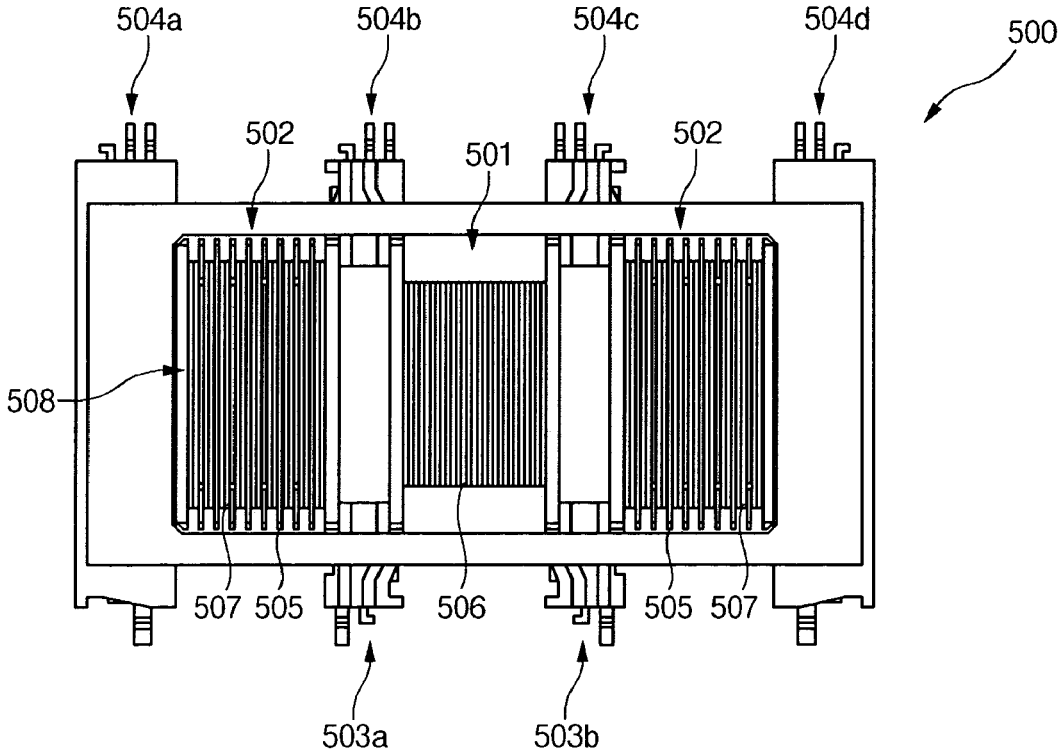
FIG. 5A is a plan view of a transformer according to a first embodiment of the present invention.
Figure 5B:
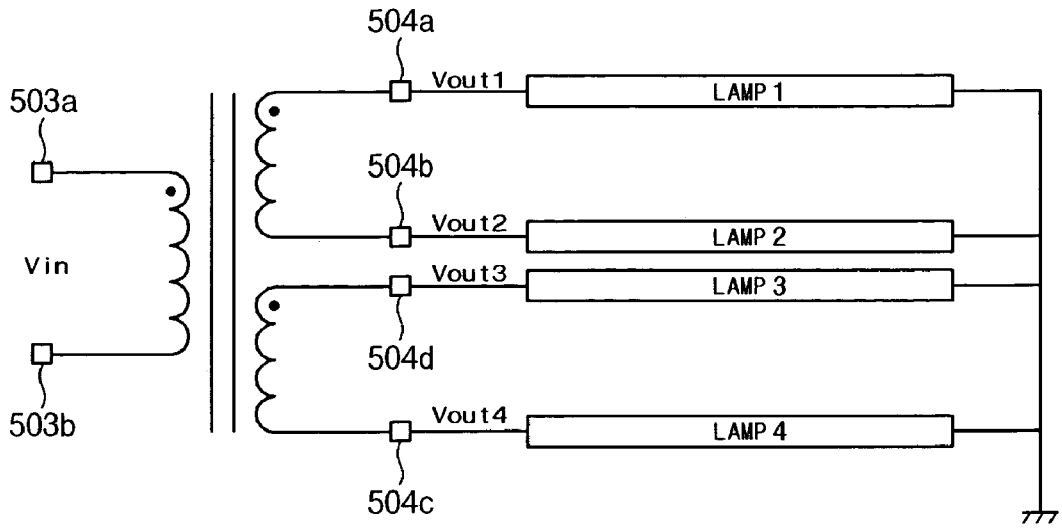
FIGS. 5B and 5C are diagrams illustrating an equivalent circuit of the transformer according to the first embodiment of the invention.
Figure 5C:
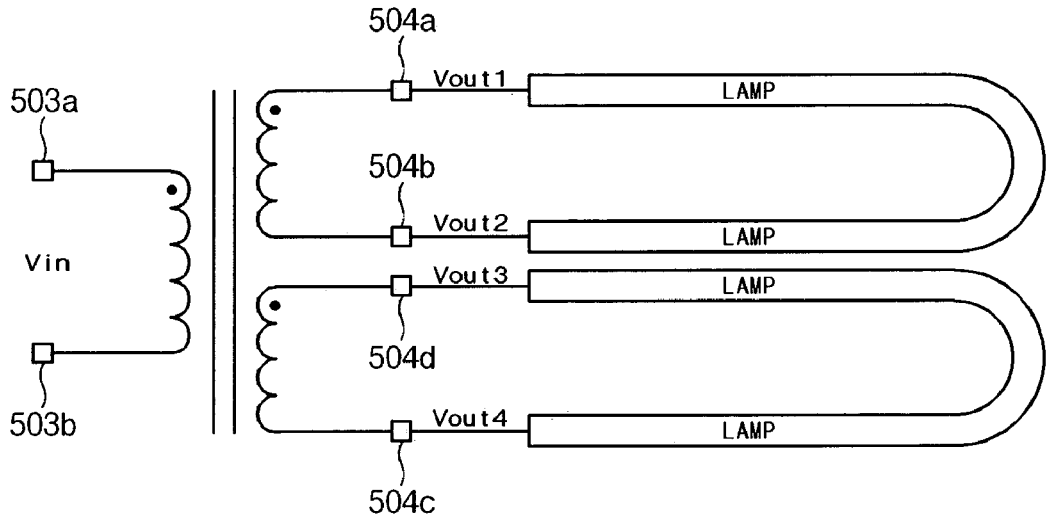

FIG. 5A is a plan view of a transformer having two secondary winding sections according to the invention, and FIGS. 5B and 5C are diagrams illustrating an equivalent circuit of the transformer.

As shown in FIG. 5A, the transformer according to the first embodiment of the invention includes a bobbin 500 composed of one primary winding section 501 and two secondary winding sections 502, in which a plurality of insulating slits 505 are formed, primary and secondary coils 506 and 507 which are respectively wound around the first and secondary winding sections 501 and 502, and a pair of cores 508 which are inserted into an insertion hole formed inside the bobbin 500.

In the transformer according to the first embodiment of the invention, the primary winding section 501 is provided with one input terminal 503*a* and one ground terminal 503*b*. Through the input terminal 503, a primary-side voltage is applied. The secondary winding section 502 is provided with four output terminals 504*a* to 504*d*. As described FIGS. 5B and 5C, four lamps or two U-shaped lamps are driven at the same time to thereby have more improved efficiency than a transformer according to the related art.

The primary winding section 501 is placed in the center of the bobbin 500, and the secondary winding sections 502 are placed in both sides of the primary winding section 501. As two of the secondary winding sections 502 are placed in one bobbin, one transformer can drive four lamps or two U-shaped lamps.

According to the present invention, one transformer can drive lamps, even in the case where four transformers should be used to drive lamps. Therefore, the cost is four times lower than when a conventional transformer is driven, and a product using the transformer can be small in size.

In the transformer according to the first embodiment of the invention, the input terminal 503*a* and the ground terminal 503 of the primary winding section 501 are placed in the same direction, and the output terminals 504*a* to 504*d* of the secondary winding section 502 are also placed in the same direction. The input terminal 503*a* of the primary winding section 501 is placed in the opposite side to the output terminals 504*a* to 504*d* of the secondary winding section 502.

When the input terminal 503*a* is placed in the opposite side to the output terminals 504*a* to 504*d* as described above, a sufficient insulation separation distance can be secured in the relation with a printed circuit board which is electrically connected to the above transformer, which makes it easy to implement a circuit.

At this time, two output terminals 504*a* and 504*d* which are placed in the outermost side from the center of the bobbin 500 can be placed on both side surfaces of the bobbin 500. In the related art, a high-voltage capacitor has been directly used on a printed circuit board. Recently, however, a method is used frequently, where patterns are widely formed on a printed circuit board to thereby manufacture a high-voltage capacitor. Therefore, when two output terminals 504*a* and 504*d* which are placed in the outermost side from the center of the bobbin 500 are placed on both side surfaces of the bobbin 500, it is easy to secure a sufficient insulation separation distance in the relation with a printed circuit board.

In winding the primary and secondary coils 506 and 507, the winding of the primary coil 506 starts from the input terminal 503*a* of the primary winding section 501 and is completed at the ground terminal 503*b* thereof. The winding of the secondary coil 507 starts from one output terminal 504*a* or 504*c* of the secondary winding section 502 and is completed at the other output terminal 504*b* or 504*d* thereof.

The pair of cores 508 are inserted into the insertion hole formed inside the bobbin 500. In the above-described transformer, an E-shaped core or UI-shaped core can be used, the UI-shaped core formed by a combination of a U-shaped core forming an outer magnetic path and an I-shaped core forming an inner magnetic path.

In the transformer according to the first embodiment of the invention as described above, the secondary winding sections 502 are placed in both sides of the primary winding section 501, all the terminals of the secondary winding sections 502 are used as the output terminals 504*a* to 504*d*, and the input terminal 503*a* is placed in the opposite side to the output terminals 504*a* to 504*d*. In such a construction, a return wire in the high-voltage output side, which has caused many problems in the related art, does not need to be provided, which means the insulation between the high-voltage output side and the return wire does not need to be considered. Further, noise due to the return wire is not generated, and a waveform of output current is not distorted.

Second Embodiment

Figure 6A:
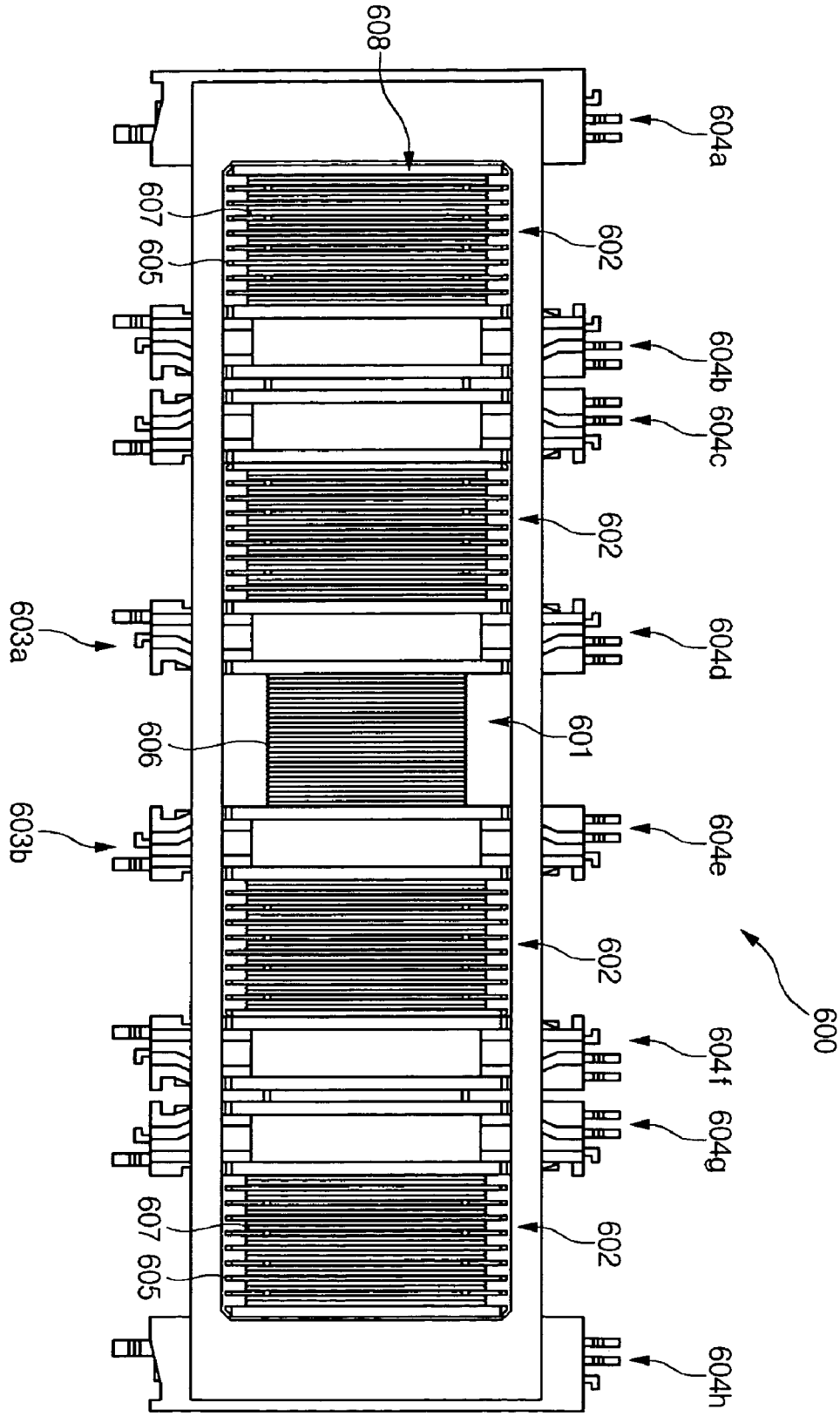
FIG. 6A is a plan view of a transformer according to a second embodiment of the invention.
Figure 6B:
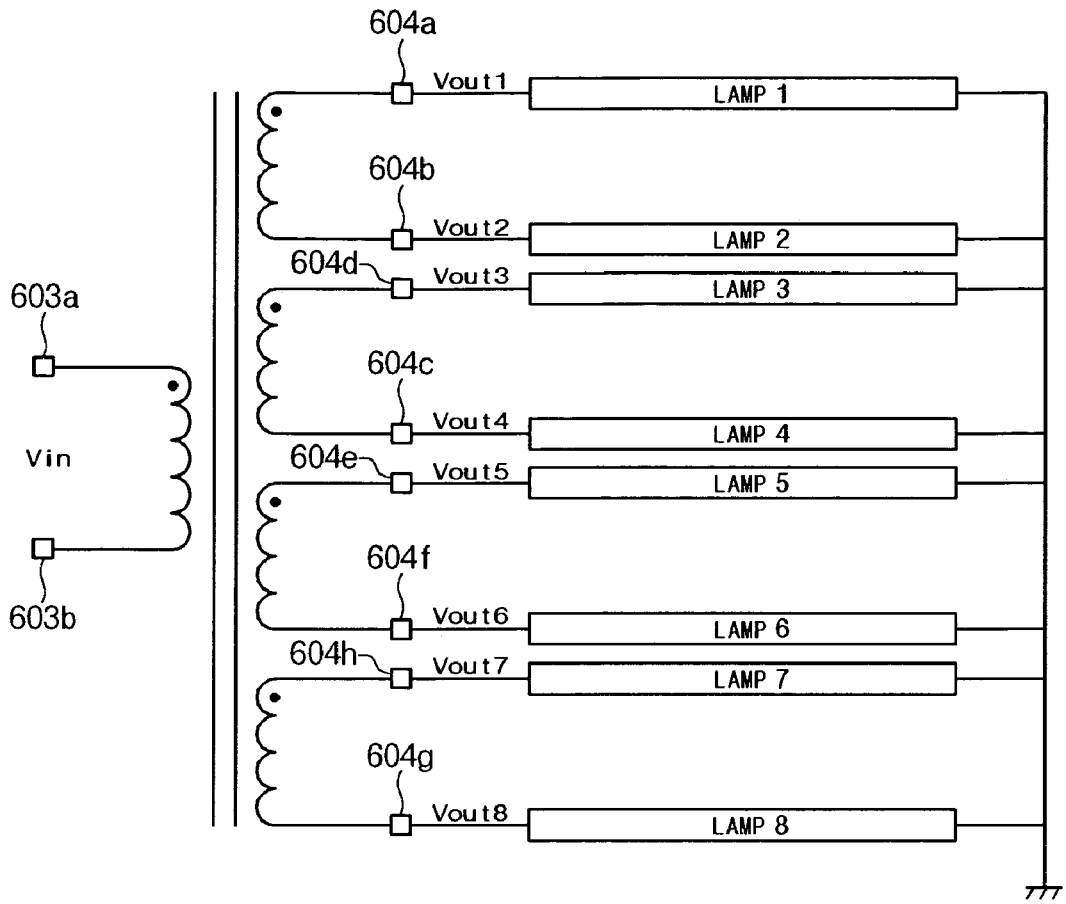
FIGS. 6B and 6C are diagrams illustrating an equivalent circuit of the transformer according to the second embodiment of the invention.
Figure 6C:
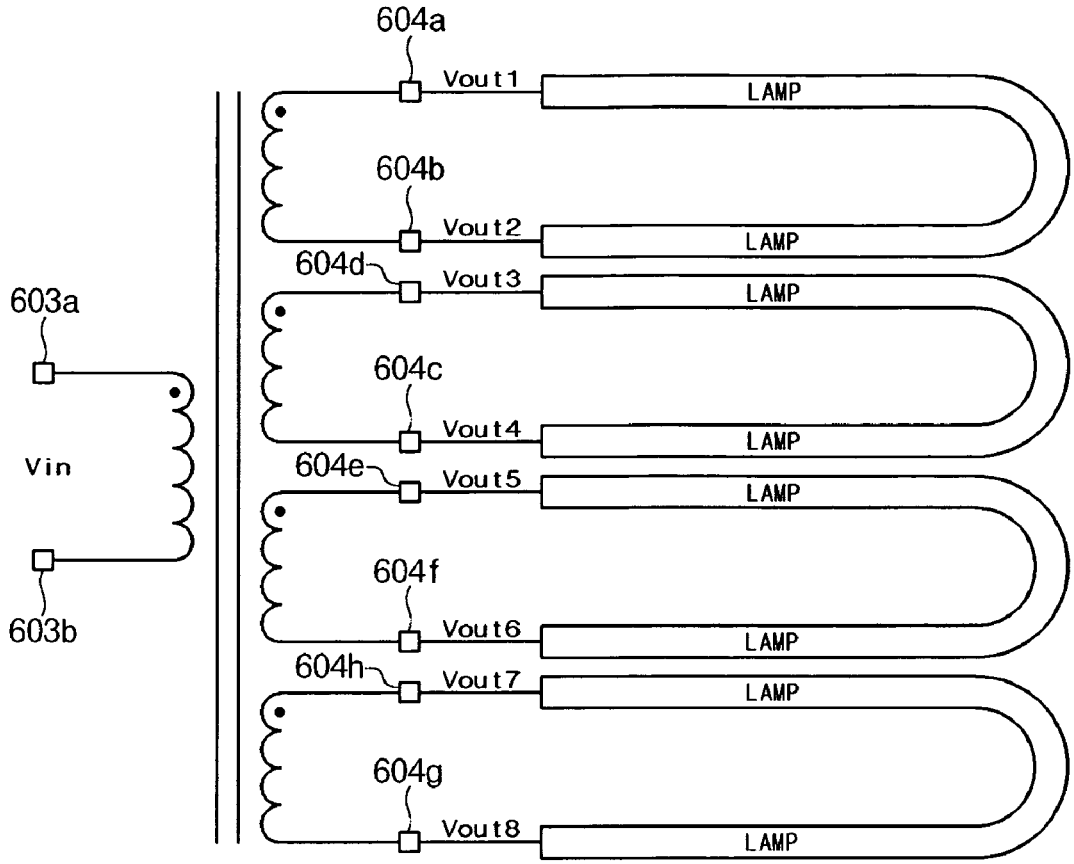

FIG. 6A is a plan view of a transformer having four secondary winding sections according to the present invention, and FIGS. 6B and 6C are diagrams illustrating an equivalent circuit of the transformer.

As shown in FIG. 6A, the transformer according to a second embodiment of the present invention includes a bobbin 600 composed of one primary winding section 601 and four secondary winding sections 602, on which a plurality of insulating slits 605 are formed, primary and secondary coils 606 and 607 which are respectively around the first and secondary winding sections 601 and 602, and a pair of cores 608 which are inserted into an insertion hole formed inside the bobbin 600.

In the transformer according to the second embodiment of the invention, the primary winding section 601 is provided with one input terminal 603*a* and out ground terminal 603*b*. Through the input terminal 603*a*, a primary-side voltage is applied. The secondary winding section 602 is provided with eight output terminals 604*a* to 605*h*. As shown in FIGS. 6B and 6C, eight lamps or four U-shaped lamps are driven at the same time to thereby have more improved efficiency than a transformer according to the related art.

The primary winding section 601 is placed in the center of the bobbin 600, and two of the secondary winding sections 602 are respectively placed in both sides of the primary winding section 601. In other words, four of the secondary winding sections 602 are placed in one bobbin, so that one transformer can drive eight lamps or four U-shaped lamps.

According to the present invention, one transformer can drive lamps, even in the case where eight transformers should be used to drive lamps in the related art. Therefore, a cost is eight times lower than when driving a conventional transformer, and a product using the transformer can be small-sized.

In the transformer according to the second embodiment of the invention, the input terminal 603*a* and the ground terminal 603*b* of the primary winding section 601 are placed in the same direction, and the output terminals 604*a* to 604*h* of the secondary winding sections 602 are placed in the same direction. The input terminal 603*a* of the primary winding section 601 is placed in the opposite side to the output terminals 604*a* to 604*h* of the secondary winding sections 602.

When the input terminal 603*a* is placed in the opposite side to the output terminals 604*a* to 604*d* as described above, a sufficient insulation separation distance can be secured in the relation with a printed circuit board which is electrically connected to the above transformer, which makes it easy to implement a circuit.

As in the first embodiment, two of the output terminals 604*a* and 604*h* which are respectively placed in the outermost side from the center of the bobbin 600 can be placed in both side surfaces of the bobbin 600.

In winding the primary and secondary coils 606 and 607, the winding of the primary coil 606 starts from the input terminal 603*a* of the primary winding section 601 and is completed at the ground terminal 603*b* thereof. The winding of the secondary coil 607 starts from each of the output terminals 604*a*, 604*c*, 604*e*, and 604*g* of the secondary winding section 602 and is completed at each of the output terminals 604*b*, 604*d*, 604*f*, and 604*h* thereof.

As in the first embodiment, the pair of cores 608 are inserted into the insertion hole formed inside the bobbin 600. In the above-described transformer, an E-shaped core or UI-shaped core can be used, the UI-shaped core formed by a combination of a U-shaped core forming an outer magnetic path and an I-shaped core forming an inner magnetic path.

In the transformer according to the first embodiment of the invention as described above, the secondary winding sections 602 are placed in both sides of the primary winding section 601, all the terminals of the secondary winding sections 602 are used as the output terminals 604*a* to 604*h*, and the input terminal 603 is placed in the opposite side to the output terminals 604*a* to 604*h*, as in the first embodiment. In such a construction, a return wire in the high-voltage output side, which has caused many problems in the related art, does not need to be provided, which means the insulation between the high-voltage output side and the return wire does not need to be considered. Further, noise due to the return wire is not generated, and a waveform of output current is not distorted.

While the present invention has been described with reference to exemplary embodiments thereof, it will be understood by those skilled in the art that various changes and modifications in form and detail may be made therein without departing from the scope of the present invention as defined by the following claims.

According to the transformer of the invention as described above, the secondary winding sections are placed in both sides of the primary winding section, all the terminals of the secondary winding sections are used as the output terminals, and the input terminal is placed in the opposite side to the output terminals. In such a construction, a return wire passing though a high-voltage output side does not need to be provided, which means the insulation between the high-voltage output side and the return wire does not need to be considered. Further, a noise due to the return wire is not generated, and a waveform of output current is not distorted.

In addition, as the input terminal is placed in the opposite side to the output terminals, a sufficient insulation separation distance can be secured in the relation with a printed circuit board which is electrically connected to the transformer, which makes it easy to implement a circuit.

Furthermore, since all the terminals of the secondary winding sections are used as output terminals to drive several lamps at the same time, improved efficiency can be obtained over a conventional transformer, there is a significant reduction in cost, and products using the transformer can be small in size.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A transformer comprising:

a bobbin composed of one primary winding section having one input terminal and one ground terminal and 2n (n: positive number) secondary winding sections, each secondary winding section having two output terminals;

a primary coil wound around the primary winding section;

secondary coils wound around the 2n secondary winding sections; and a pair of cores that are respectively inserted into an insertion hole formed inside the bobbin.

2. The transformer according to claim 1, wherein the primary winding section is placed in the center of the bobbin, and the n secondary winding sections are respectively placed in both sides of the primary winding section.

3. The transformer according to claim 1, wherein, on the primary and secondary winding sections, a plurality of insulating slits are formed.

4. The transformer according to claim 1, wherein, when the primary coil is wound, the winding starts from the input terminal of the primary winding section and is completed at the ground terminal thereof.

5. The transformer according to claim 1, wherein, when the secondary coil is wound, the winding starts from one output terminal of the secondary winding section and is completed at the other output terminal thereof.

6. The transformer according to claim 1, wherein the input terminal and ground terminal of the primary winding section are placed in the same direction.

7. The transformer according to claim 1, wherein the output terminals of the secondary winding section are placed in the same direction.

8. The transformer according to claim 1, wherein the input terminal of the primary winding section is placed in the opposite side to the output terminals of the secondary winding sections.

9. The transformer according to claim 1, wherein two output terminals placed in the outermost sides from the center of the bobbin are placed on both side surfaces of the bobbin.

10. The transformer according to claim 1, wherein the core is an E-shaped core.

11. The transformer according to claim 1, wherein the core is formed by a combination of a U-shaped core forming an outer magnetic path and an I-shaped core forming an inner magnetic path.

* * * * *